US006921253B2

(12) United States Patent
Shuler et al.

(10) Patent No.: US 6,921,253 B2
(45) Date of Patent: Jul. 26, 2005

(54) DUAL CHAMBER MICROPUMP HAVING CHECKVALVES

(75) Inventors: Michael Shuler, Ithaca, NY (US); Aaron Sin, Brighton, MA (US)

(73) Assignee: Cornell Research Foundation, Inc., Ithaca, NY (US)

( * ) Notice: Subject to any disclaimer, the term of this patent is extended or adjusted under 35 U.S.C. 154(b) by 0 days.

(21) Appl. No.: 10/325,624

(22) Filed: Dec. 19, 2002

(65) Prior Publication Data

US 2003/0152463 A1 Aug. 14, 2003

Related U.S. Application Data

(60) Provisional application No. 60/342,625, filed on Dec. 21, 2001.

(51) Int. Cl.[7] ..... F04B 35/02

(52) U.S. Cl. ..... 417/559; 417/571; 417/563; 417/567; 417/413.2; 417/413.3

(58) Field of Search ..... 417/322, 348, 417/349, 559, 563, 567, 571, 413.1–413.3; 137/333.11, 517, 514.5

(56) References Cited

U.S. PATENT DOCUMENTS

| | | | | |
|---|---|---|---|---|
| 4,439,112 A | * | 3/1984 | Kitsnik | 417/383 |
| 4,911,616 A | * | 3/1990 | Laumann, Jr. | 417/413.3 |
| 4,984,970 A | * | 1/1991 | Eickmann | 417/271 |
| 5,259,737 A | | 11/1993 | Kamisuki et al. | 417/322 |
| 5,288,214 A | * | 2/1994 | Fukuda et al. | 417/395 |
| 5,542,821 A | * | 8/1996 | Dugan | 417/53 |
| 5,759,014 A | | 6/1998 | Van Lintel | 417/413.3 |
| 6,042,345 A | * | 3/2000 | Bishop et al. | 417/322 |
| 6,340,294 B1 | * | 1/2002 | Kubota et al. | 417/395 |
| 6,368,079 B2 | * | 4/2002 | Peters et al. | 417/413.2 |
| 6,520,753 B1 | * | 2/2003 | Grosjean et al. | 417/379 |
| 6,554,591 B1 | * | 4/2003 | Dai et al. | 417/505 |
| 6,575,715 B1 | * | 6/2003 | Rastegar | 417/413.2 |
| 6,623,256 B2 | * | 9/2003 | Takagi et al. | 417/413.2 |
| 6,644,944 B2 | * | 11/2003 | Karp | 417/566 |
| 6,685,443 B2 | * | 2/2004 | Simmons et al. | 417/395 |
| 2003/0095870 A1 | * | 5/2003 | Park | 417/53 |

OTHER PUBLICATIONS

Cunneen, James, et al., "A positive displacement micropump for microdialysis", *Mechatronics 8(5)*, (Aug. 1998), 561–583.

Gerlach, T., et al., "Working principle and performance of the dynamic micropump", *Sensors and Actuators A (Physical), A50 (1–2)*, (Aug. 1995), 135–140.

Meng, E., et al., "A checked–valved silicone diaphragm pump", *Proceedings IEEE Thirteenth Annual International Conference on Micro Electro Mechanical Systems*, (2000), 62–67.

* cited by examiner

*Primary Examiner*—Cheryl Tyler
*Assistant Examiner*—Emmanuel Sayoc
(74) *Attorney, Agent, or Firm*—Schwegman, Lundberg, Woessner & Kluth, P.A.

(57) ABSTRACT

A micropump has two chambers separated by an actuator for causing fluid to flow in the chambers. Each chamber is equipped with a ball that acts as a valve for allowing flow in a desired direction. The balls are heavier than the fluid being pumped, and reside at an interface between the chambers and passages feeding fluid into the chambers and provide a tight seal between the chambers and passages feeding the chambers when fluid pressure forces the fluid back toward the feeding passages.

15 Claims, 4 Drawing Sheets

DUAL CHAMBER MICROPUMP HAVING CHECKVALVES

CLAIM PRIORITY TO PROVISIONAL

This application claims benefit under 35 U.S.C. 119(e) of U.S. Provisional Application Ser. No. 60/342,625, filed Dec. 21, 2001, which is incorporated herein by references.

GOVERNMENT FUNDING

The invention described herein was made with U.S. Government support under NSF Grant Number DMR-9876771. The government has certain rights in the invention.

FIELD OF THE INVENTION

The present invention relates to small pumps, and in particular to a self priming micropump.

BACKGROUND OF THE INVENTION

Micropumps are used to pump small amounts of fluid. It is sometimes desirable to pump the fluid at slow flow rates to allow testing of the fluid by different miniature sensors, such as micro-electro-mechanical devices and micro-chemical analysis systems. Such pumps are useful in miniature fluid handling systems. Miniature chemical analysis systems utilize small sample volumes integrated with chemical sensors and/or separation devices such as electrophoresis systems and application methods such as polymerase chain reaction. The micropumps provide the ability to move fluid through such systems in at a desired flow rate.

Current micropumps exhibit one or more of the following problems. Some are made with glass, quartz or silicon, and are difficult to work with. Many utilize checked-valve diaphragm pumps, or passive diffuser valves. Many of such devices lack efficiency and ability to produce recirculating flow. Further, many of the devices need to be primed in order to operate, adding to difficulties of use.

SUMMARY OF THE INVENTION

A micropump has two chambers separated by an actuator for causing fluid to flow in the chambers. Each chamber is equipped with a ball that acts as a valve for allowing flow in a desired direction. The balls in one embodiment, are heavier than the fluid being pumped, and reside at an interface between the chambers and passages feeding fluid into the chambers. The passages have a smaller diameter than the balls.

In one embodiment, the chambers and passages are formed of plastic, such as Plexiglas or polymethylmethacrylate (PMMA), and the actuator is formed of a patterned flexible material that changes volume in response to pressure applied to it, causing the fluid to flow. The balls are made of ruby ball bearings designed to provide a tight seal between the chambers and passages feeding the chambers when fluid pressure forces the fluid back toward the feeding passages. In other embodiments, the balls are made with aluminum, steel, polystyrene, or other material.

The chambers and passages are formed by drilling holes in the Plexiglas. The actuator is formed by patterning a flexible material such as poly-dimethylsiloxane (PDMS), and then attaching it to the Plexiglas. A pumping passage is formed between the Plexiglas and patterned material such that it connects an output of one chamber to the feeding or supply passage for another chamber. A set of valves coupled to high and low pressure sources is used to create forces applied to the flexible material about the pumping passage to change its volume. The frequency of forces applied vary from 0.1 to 10.0 Hz in one embodiment. In further embodiments, different types of devices capable of actuating the pumping passage are used.

DETAILED DESCRIPTION OF THE INVENTION

In the following description, reference is made to the accompanying drawings which form a part hereof, and in which is shown by way of illustration specific embodiments in which the invention may be practiced. These embodiments are described in sufficient detail to enable those skilled in the art to practice the invention, and it is to be understood that other embodiments may be utilized and that structural, logical and electrical changes may be made without departing from the scope of the present invention. The following description is, therefore, not to be taken in a limited sense, and the scope of the present invention is defined by the appended claims.

Figure 1:
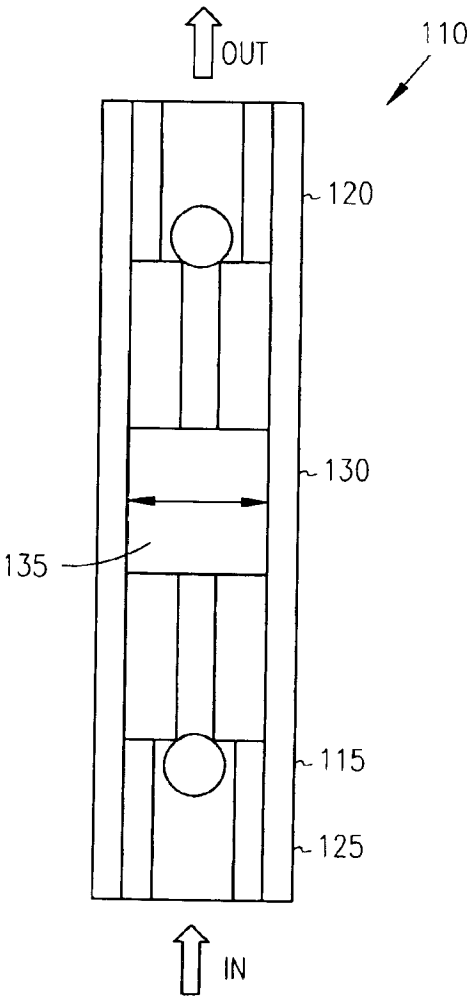
FIG. 1 is a block schematic diagram of a micropump in accordance with the present invention.

FIG. 1 is a schematic diagram of a micropump 110 for controllable pumping fluids. Micropump 110 comprises a pair of sets of capillaries 115 and 120. The pair of capillary sets 115 and 120 are coupled together by a tube 125. A portion 130 of the tube 125 between the pair of capillary sets is oscillated by an actuator to provide pumping force by alternately increasing and reducing the volume of a chamber 135 defined by the portion 130. The actuator provides positive displacement by the use of pneumatic pressure.

Figure 2:
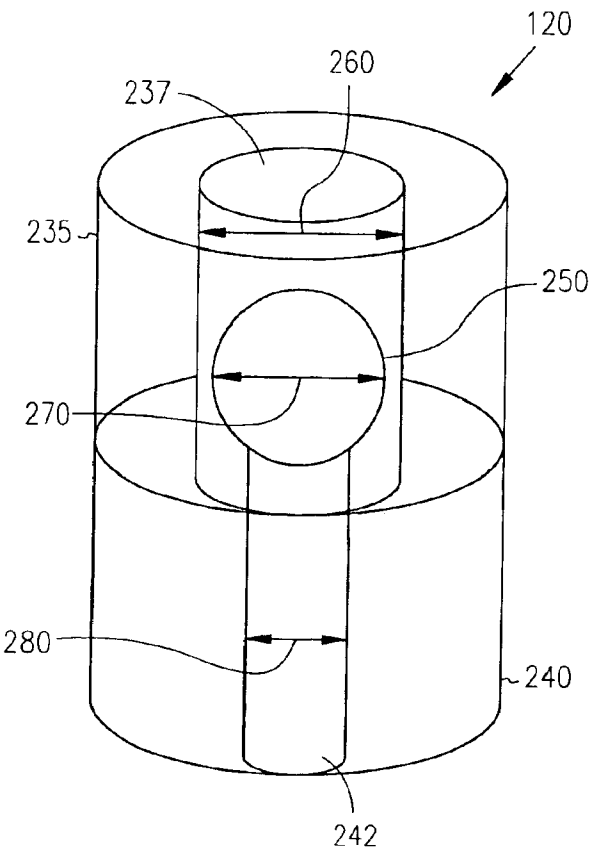
FIG. 2 is a block schematic diagram of one valve of the micropump of FIG. 1.

In one embodiment, the set of capillaries 115 is shown in further detail in a schematic representation in FIG. 2. The capillaries are formed of glass in one embodiment, but may also be formed of other materials. The set comprises a first capillary 235 defining a first chamber 237 and a second capillary 240 defining an input passage 242. Input passage 242 connects to the first chamber 237 for providing fluid flow from the input to the chamber. A first ball 250 is disposed within the first chamber 237. The first chamber 237 has a diameter 260 which in one embodiment is approximately 550 microns. The first ball 250 has a smaller diameter of approximately 400 microns. The input passage 242 has a diameter of approximately 280 microns. The diameter of the input passage 242 is selected to be smaller than that of the first ball so that the ball cuts off back flow into the input passage by contacting the input passage when fluid is pushed back toward the input passage.

The first ball 250 is heavier than the fluid in one embodiment wherein the first capillary 235 is physically placed above the second capillary 240. The first ball 250 thus moves toward the interface between the first and second capillaries when fluid is not moving. The first ball 250 is lighter than the fluid in a further embodiment where the capillaries are reversed. In either case, the first ball tends to move toward the interface between the capillaries. In yet a further embodiment, the first ball is approximately the same weight as the fluid, and simply moves with the fluid. When it reaches the interface, it prevents backflow of fluid from the first chamber 237 into the input passage 242. In yet a further embodiment, the balls are common ball bearings made with aluminum.

The second set of capillaries 120 in FIG. 1 are constructed similarly to the first set of capillaries. For reference, the second set of capillaries includes a second chamber, a second ball and a second input. When the portion 130 of the tube 125 is oscillated, it causes fluid to move in the sets of capillaries by changing the volume of chamber 135. The term fluid includes liquids and gases.

Increasing the volume of the chamber draws fluid into the pump 110 via the second set of capillaries 120. The second ball is moved away from the interface between the second chamber and the second input passage, allowing fluid to flow toward the first set of capillaries 115. However, as the volume of pumping chamber 135 increases, the first ball is forced into contact with the interface between the first chamber and first input passage, preventing backflow. The forced contact occurs whether the fluid is a liquid or a gas, such that the pump is self priming. The contact also occurs via gravity, providing a very good valve function for priming the pump.

The rate of flow of the fluid is dependent on the diameters of the capillaries, volume changes of the pumping chamber, and the frequency of oscillation of the actuation of the pumping chamber. Using these parameters, very small and slow flow rates are established in some embodiments, facilitating use of the pump in miniature analysis systems such as a lab on a chip.

Figure 3:
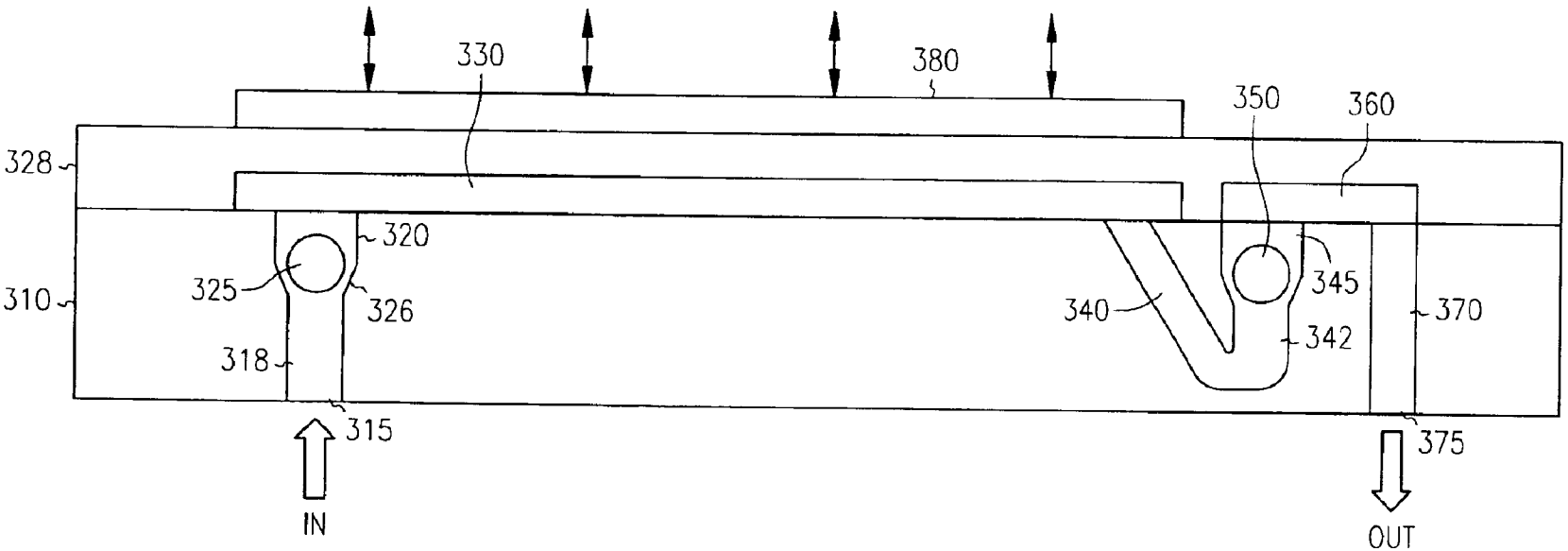
FIG. 3 is a block schematic cross section view of one embodiment of the micropump.

A further embodiment of a micropump in accordance with the invention is shown in cross section in FIG. 3. The micropump is formed by drilling holes in a sheet of Plexiglas substrate 310 or other material such as plastic that is somewhat rigid, yet drillable. A first input opening 315 and first input passage 318 are formed in the substrate 310 for introducing fluid into the micropump through the bottom of the substrate 310. A larger first chamber 320 is then formed. The first input passage and first chamber are formed by drilling in one embodiment. Other methods may also be used.

A first ball 325 is placed in the first chamber 320. The first ball has a smaller diameter than the first chamber, but larger than the diameter of the first passage. A first chamfer 326 is formed at the junction or interface of the first chamber and first passage. The ball 325 is sized to fit against sides of the chamfer 326 to operate as a valve. In further embodiments, no chamfer is utilized, and the ball directly fits against the input passage.

A flexible material 328 such as PDMS is patterned, as by pressing with use of a mold, or photolithographic or other technique. In one embodiment, a silicon master is first fabricated and used heat and pressure to pattern the flexible material. A top of a pumping passage 330 is formed in the flexible material, with the top of the substrate serving as a bottom of the pumping passage 330 when the flexible material 328 is coupled to the substrate 310. Thus, soft lithography and bulk machining have been combined to manufacture the micropump.

Prior to coupling the flexible material 328 to the substrate 310, a second input passage 340 is formed in the substrate 310. The second input passage is formed at an angle into the substrate, and intersects with another part of the input passage indicated at 342, which in turn couples to a second chamber 345 extending to the top of the substrate 310. Again, these passages and chambers are formed by drilling or other method. A second ball 350 is placed in the second chamber and acts as a valve to prevent backflow from the second chamber into the input passage. The flexible layer is patterned to provide an output passage 360 from the second chamber. A further output passage 370 coupled to the output passage 360 is formed through the substrate to provide an output opening 375 in the bottom of the substrate 310. In a further embodiment, a depression is formed in the substrate 310 to connect the output passages without the need for patterning the flexible material. Several known methods are available for forming such a depression, trough, channel or other structure.

After formation of the passages and chambers, the flexible material is attached to the substrate 310 in a substantially fluid tight manner, such as by use of a suitable adhesive or other bonding technique. A actuator 280 is coupled to the top of the flexible layer 328 about the pumping passage 330 to controllably modify the volume of the pumping passage 330. Modifying the volume of the pumping passage 330 provide a pumping action similar to that described with respect to the schematic diagrams of FIGS. 1 and 2. The first and second balls act as valves to prevent backflow.

Figure 4:
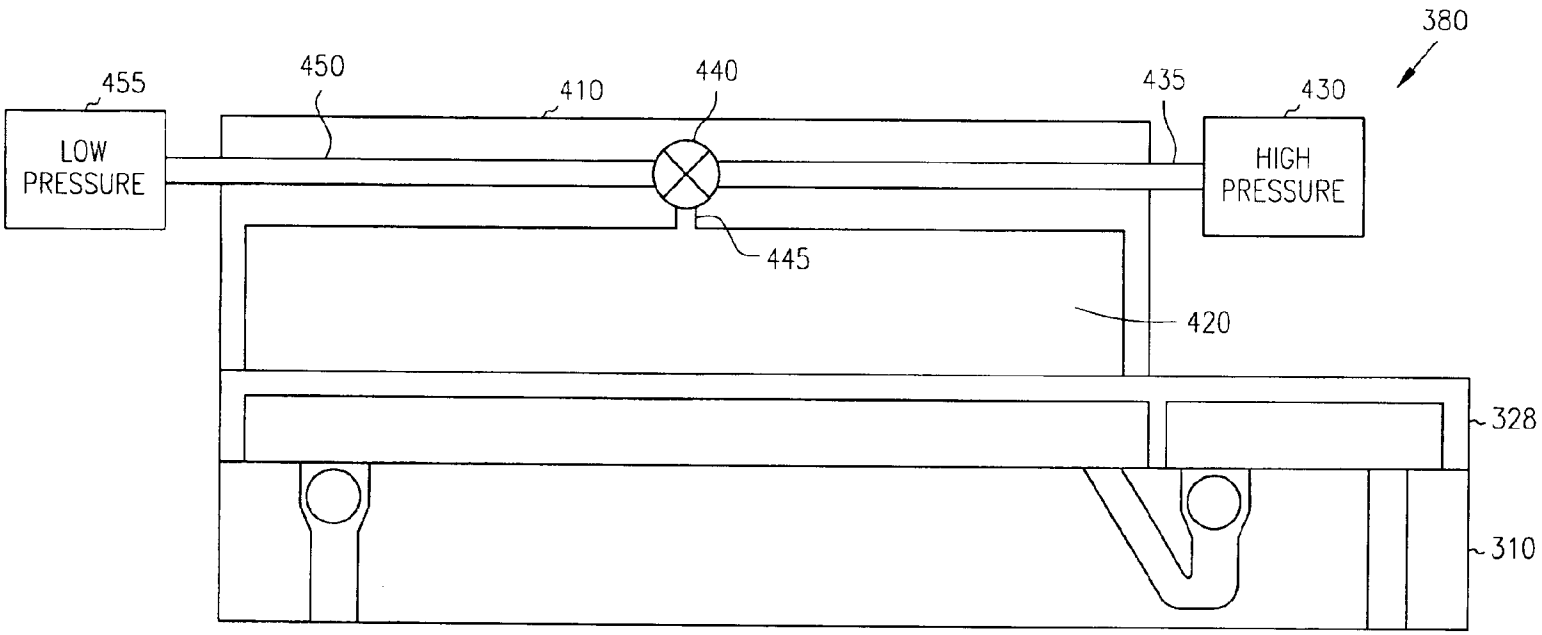
FIG. 4 is block diagram showing further detail of an actuator for the micropump of FIG. 2.

Further detail of the actuator is shown in a block cross section diagram in FIG. 4. The portion of the micropump formed in the substrate 310 and flexible layer 328 are the same as in FIG. 3. Actuator 380 comprises a container 410 that includes a pressure chamber 420. The pressure chamber 420 is coupled to the flexible layer 328 over the pumping passage. Changes in the pressure of the pressure chamber cause movement of a portion of the flexible layer about the pumping passage to cause changes in volume of the pumping passage. A high pressure source 430 is coupled to the pressure chamber by a passage 435, such as a pressure fitting and suitable tubing to a multivalve control valve 440. The control valve 440 is coupled to the pressure chamber via a passage 445.

Control valve 440 is coupled via a passage 450 to a low pressure source 455. The control valve oscillates between the high pressure source and low pressure source to vary the pressure in the pressure chamber 420. In one embodiment, the frequency of oscillation varies between 0.1 and 10 Hz, with the high pressure between 1 and 2 atmospheres, and the low pressure source of between a vacuum and approximately 1 atmosphere. In one embodiment, the pumping passage is between approximately 20–100 microns in height, with a variable width, but at least the width of the diameter of the first and second chambers. These parameters are adjustable outside of the ranges provided above, but are modifiable to obtain desired flow rates. Reducing the height of the pumping passage acts to reduce the flow rate.

In one embodiment, the substrate 310 is formed in the following manner. Silane primer (Prime Coat 1205, Dow Corning, Midland, Mich.) is spun-coated onto ¼" thick (6.36 mm) PMMA sheets (McMaster-Carr, New Brunswick, N.J.) at 100 rpm for 30 seconds. The coated pieces are left to dry in a fume hood for 5–10 minutes. Valve seats are fabricated by drilling counterbored holes in the PMMA block with diameters of 500 um (drill size #76) at the top half of the channel, and 300 um (drill size #83) at the bottom. Connecting channels of 300 um diameter were also drilled.

In one embodiment, the flexible material 328 is formed by first patterning a photoepoxy SU-8 (Microlithography Corp., Newton, Mass.) on a silicon wafer to create a master. Sylgard 184 PDMS prepolymer (Dow Corning, Midland, Mich.) is mixed according to manufacturer's instructions and degassed at 34 kPa vacuum. The degassed prepolymer mixture is poured onto the master and cured overnight at 65 C. The PDMS replica is then peeled from the master and cut to form a top piece of the micropump.

The substrate 310 is cleaned with isopropanol prior to bonding with the flexible material 328. Both substrate and flexible material are oxidized in an oxygen plasma barrel etcher (P2000, Branson IPC) at 150 W for 2 minutes. Immediately after removal from the barrel etcher, the two surfaces are submerged in de-ionized water. Synthetic ruby balls (1/64" or 400 um diameter, Small Parts) are inserted into valve seats (chamfer areas) in the substrate. The pieces are then brought into contact while keeping a water film between to facilitate alignment and prevent trapping air pockets. An irreversible bonding between the pieces is formed after evaporating the water overnight in a 65 C oven. In one embodiment, the PMMA is coated by a silane primer prior to the oxygen plasma treatment.

A pneumatic actuator was formed with a PMMA block machined to mount a three-way solenoid valve (LHDA1221111H, Lee Company, Westbrook Conn.), with connections for positive and negative pressure as seen in FIG. 4. Actuation is controlled using a 12V peak sinusoidal electric signal with 0V DC offset modulated by a function generator (4017, BK Precision, Placentia, Calif.). Positive and negative pressure are supplied using a pressure/vacuum pump (2545, Welch Vacuum, Thomas Industries, Skokie, Ill.) at 67 kPa above and below atmospheric pressure.

Figure 5:
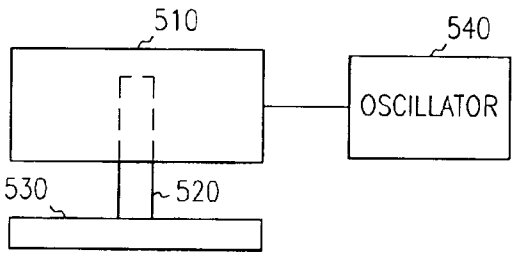
FIG. 5 is a block diagram of an alternative actuator.

An alternative actuator is shown in block diagram form in FIG. 5. In this embodiment, the actuator comprises a solenoid 510 having a moving arm 520 coupled to a pressure plate 530. The solenoid moves the pressure plate against the flexible membrane about the pumping passage to change the volume in the pumping passage. An oscillator 540 is coupled to the solenoid to control the force and frequency of the solenoid. Further actuators, such as piezoelectric or electromagnetic actuators are used in further embodiments.

Figure 6:
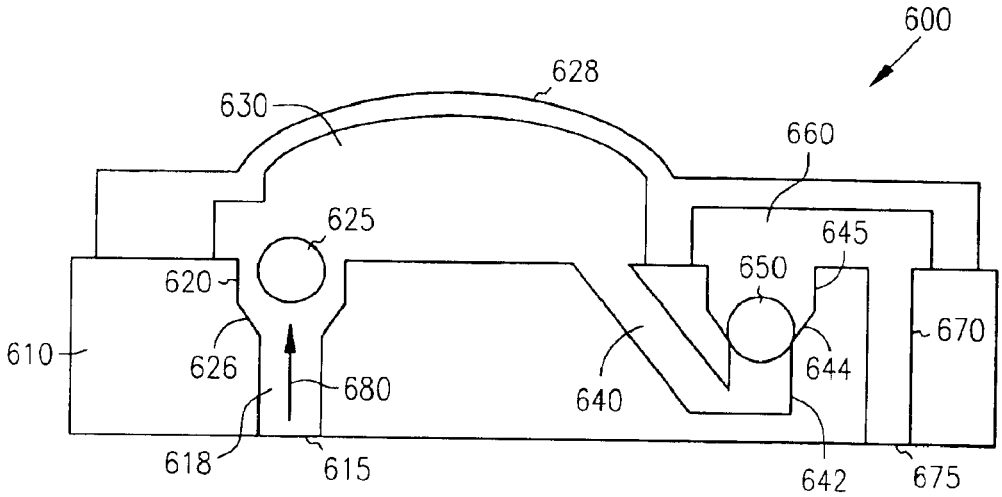
FIG. 6 is a block schematic cross section view of operation of an example micropump.
Figure 7:
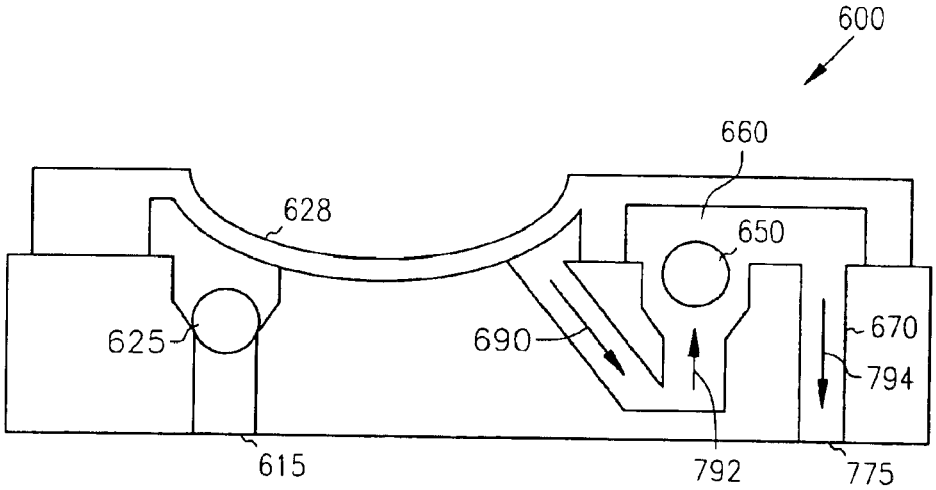
FIG. 7 is a block schematic cross section view of further operation of the example micropump of FIG. 6.

FIGS. 6 and 7 are cross sections of an example micropump 600 in different stages of operation, illustration fluid flow and ball position. Micropump 600 is similar to the micropump shown in FIG. 3, with the actuator removed for a better illustration of functioning. A first input opening 615 and first input passage 618 are formed in a substrate 610 for introducing fluid into the micropump 600 through the bottom of the substrate 310. A larger first chamber 620 is then formed. The first input passage and first chamber are formed by drilling in one embodiment. Other methods may also be used.

A first ball 625 is placed in the first chamber 620. The first ball has a smaller diameter than the first chamber, but larger than the diameter of the first passage. A first chamfer 626 is formed at the junction or interface of the first chamber and first passage. The ball 625 is sized to fit against sides of the chamfer 626 to operate as a valve. In further embodiments, no chamfer is utilized, and the ball directly fits against the input passage.

A flexible material 628 such as PDMS is patterned, as by pressing with use of a mold, or photolithographic or other technique. In one embodiment, a silicon master is first fabricated and used heat and pressure to pattern the flexible material. A top of a pumping passage 630 is formed in the flexible material, with the top of the substrate serving as a bottom of the pumping passage 630 when the flexible material 628 is coupled to the substrate 610.

Prior to coupling the flexible material 628 to the substrate 610, a second input passage 640 is formed in the substrate 610. The second input passage is formed at an angle into the substrate, and intersects with another part of the input passage indicated at 642, which in turn couples to a second chamber 645 extending to the top of the substrate 610. Again, these passages and chambers are formed by drilling or other method. A second ball 650 is placed in the second chamber and acts as a valve to prevent backflow from the second chamber into the input passage. The flexible layer is patterned to provide an output passage 660 from the second chamber. A further output passage 670 coupled to the output passage 660 is formed through the substrate to provide an output opening 675 in the bottom of the substrate 610. In a further embodiment, a depression is formed in the substrate 610 to connect the output passages without the need for patterning the flexible material. Several known methods are available for forming such a depression, trough, channel or other structure.

After formation of the passages and chambers, the flexible material is attached to the substrate 610 in a substantially fluid tight manner, such as by use of a suitable adhesive or other bonding technique. A actuator (not shown) is coupled to the top of the flexible layer 628 about the pumping passage 630 to controllably modify the volume of the pumping passage 630. Modifying the volume of the pumping passage 630 provide a pumping action similar to that described with respect to the schematic diagrams of FIGS. 1 and 2. The first and second balls act as valves to prevent backflow.

In FIG. 6, fluid is flowing into the pumping passage 630 as indicated by an arrow 680, as the flexible layer has been actuated to a position away from the substrate 610. This actuation causes the pumping passage 630 to expand and draw fluid into itself. The first ball 625 is floating above the chamfer 626, allowing the fluid to flow around it. The second ball 650 is seated in a chamfer 644 between passages input passage 642 and second chamber 645, preventing fluid from exiting the pumping passage 630.

Once the pumping passage 630 is filled to a desired extent, the actuator forces the flexible layer 628 toward the substrate 610, causing the first ball to seat in chamfer 626, and the second ball 650 to rise above the chamfer 644, and the fluid to flow around it and out of the substrate as illustrated by arrows 792, 794 and 796. It should be noted, that rather than flowing out of the substrate, other passages may be formed in the substrate, and the fluid is simply pumped to such other passages or devices.

CONCLUSION

The invention comprises a unique arrangement of valves using balls to provide a micropump having excellent small volume and rate controls with minimal backflow. In addition, the micropump is self-priming. In one embodiment, the micropump interfaces with channels that match the size of capillaries and small blood vessels, approximately 10 um. The micropump provides a flow rate of approximately 2 uL/min to achieve desired liquid residence time in chambers of attached devices and physiological hydrodynamic shear stress imposed on cell cultures. While certain materials have been described as useful in various embodiments, it is recognized that many other materials suitable for forming similar structures are available without departing from the scope of the invention. Many other actuators or methods of causing fluid to flow may be used, such as various vibrating elements including piezoelectric discs and electromagnets. In yet further embodiments, the flexible layer need not be flexible, but a bladder may be inserted in the pumping chamber or passage to change the volume therein and cause a pumping action. Still further, while balls or spheres are described as part of the valves, other similar shapes may be utilized which are not perfectly round without departing from the scope of the invention. The ball valves provide a tight seal and higher efficiency. The ball valves also provide the ability to produce recirculating flow and a self-priming pump. The micropump is made mostly with plastics, and provides tight efficient ball valves to prevent back flow.

What is claimed is:

1. A micropump comprising, a bottom substrate layer;

a top substrate layer;

a first chamber formed in the bottom substrate layer, and having a microfluidic input at a bottom portion of the first chamber;

a first ball disposed in the first chamber;

a second chamber formed in the bottom substrate layer, and having a microfluidic input at a bottom portion of the second chamber;

a second ball disposed in the second chamber;

and a microfluidic pumping passage formed between the top and bottom substrate layers and fluidically coupled between the first and second chambers;

wherein fluid enters from the bottom substrate to the first chamber through a microfluidic input at a bottom portion of the first chamber, said fluid enters the microfluidic pumping passage in the top substrate, flows back down to the bottom substrate, enters the microfluidic input at a bottom portion of the second chamber, and exits through the top substrate;

and wherein the first and second balls act as valves to promote one-way flow of fluid.

2. The micropump of claim 1 wherein the actuator comprises electromagnets or piezoelectric material.

3. The micropump of claim 1 wherein the actuator oscillates.

4. The micropump of claim 3 wherein the actuator oscillates at approximately 1 Hz.

5. The micropump of claim 1 and further comprising an actuator positioned adjacent the pumping passage for pumping fluid.

6. The micropump of claim 1 wherein the pumping passage is formed at least partially of a flexible material to facilitate a change in volume of the pumping passage.

7. The micropump of claim 1 wherein the balls are heavier than the fluid, and have a larger diameter than the respective inputs, and a smaller diameter than the respective chambers.

8. The micropump of claim 3 wherein the balls are ball bearings.

9. The micropump of claim 1 wherein the chambers are formed in a sheet of Plexiglas, Lexan, or other rigid plastic.

10. The micropump of claim 1 wherein the micropump is self priming.

11. The micropump of claim 1 wherein the balls minimize backflow.

12. The micropump of claim 1 wherein the balls are denser or lighter than the fluid.

13. The micropump of claim 1 wherein the balls are aluminum or ruby.

14. The micropump of claim 1 wherein the balls are either lighter or heavier than the fluid.

15. The micropump of claim 1 wherein one of the fluid input or outputs of each chamber is chamfered to mate with the respective balls to provide a check valve.

* * * * *